US005163353A

United States Patent [19]

Horstmann et al.

[11] Patent Number: 5,163,353

[45] Date of Patent: Nov. 17, 1992

[54] ENERGY SAVING AND MONITORING PNEUMATIC CONTROL VALVE SYSTEM

[75] Inventors: Theodor H. Horstmann, Wilmington, Del.; Alfred R. Weber, Athens, Ga.

[73] Assignee: Ross Operating Valve Company, Troy, Mich.

[21] Appl. No.: 807,033

[22] Filed: Dec. 12, 1991

[51] Int. Cl.[5] ..... F15B 11/08; F15B 13/04

[52] U.S. Cl. ..... 91/426; 91/446; 91/448; 91/468

[58] Field of Search ..... 91/426, 444, 446, 448, 91/468

[56] References Cited

U.S. PATENT DOCUMENTS

| | | | |
|---|---|---|---|
| 3,253,516 | 5/1966 | Huntington et al. | 91/426 |
| 3,943,972 | 3/1976 | Bitonti et al. | 91/448 X |
| 4,493,244 | 1/1985 | Stillfried et al. | 91/448 X |
| 4,523,513 | 6/1985 | Gudat et al. | 91/446 X |
| 4,700,612 | 10/1987 | Pfister | 91/448 X |

*Primary Examiner*—John T. Kwon
*Assistant Examiner*—John Ryznic
*Attorney, Agent, or Firm*—Harness, Dickey & Pierce

[57] ABSTRACT

An improved pneumatic control system is selectively deactuable and actuable for controlling movement of the armature of a pneumatically-operated device between first and second working positions and includes a timing subsystem that enhances the efficiency of the overall system by stabilizing the control system at a pressure necessary to maintain certain static conditions in the pneumatically-operated device, while still providing for full control air pressure when dynamic operations are required. In addition, such a control system compensates for system leakage in an efficient manner by using full control air pressure only when needed for proper operating functions of the overall system.

46 Claims, 6 Drawing Sheets

ENERGY SAVING AND MONITORING PNEUMATIC CONTROL VALVE SYSTEM

BACKGROUND AND SUMMARY OF THE INVENTION

The invention relates generally to pneumatic control valves or control valve systems for selectively controlling the movement of pneumatically-operated devices or systems, such as pneumatically-actuated cylinders, clutches, or brakes, for example, used to operate various pneumatically-operated devices, such as presses, linkages, etc. More particularly, the present invention relates to such pneumatic control valve systems that are adapted to conserve energy by minimizing the pneumatic air pressure needed during certain parts of the operation, as well as being adapted to compensate for, and monitor, any air leakage in the pneumatically-operated device or in the overall system.

Pneumatic control valves or control valve systems are commonly used in various operations or processes for controlling the flow of pressurized control air to and from a pneumatically-operated cylinder or other such actuating device having a movable work-performing member or armature. Frequently, however, the pneumatically-operated device is not constantly in motion, with the work-performing member being held in a stationary position during various portions of the operation. The maintaining of full line control air pressure during periods when the movable armature of the pneumatically-operated device is required to be held in a stationary position has been found to be wasteful of energy required to run compressors or other such devices. In addition, in many pneumatically-operated systems, especially in systems employing older equipment, leakage inevitably occurs in the pneumatically-operated device or in related systems or subsystems. The maintaining of full line control air pressure and flow in order to compensate for such leakage has also been found to be expensive and wasteful in terms of energy usage, especially in systems such as those described above wherein a movable armature is required to be held in a stationary position during various portions of the operation of the system.

Accordingly, the need has arisen for a pneumatic control valve or control valve system that is capable of addressing the above-mentioned problems in a more energy-efficient manner. To this end, in accordance with the present invention, it has been found that a pneumatically-operated cylinder or other such device can be held in a stationary or static condition with approximately thirty percent to forty percent of the air pressure needed for dynamic operation. In addition, it has been found that it is not necessary to continuously and instantaneously compensate for leakage in the pneumatically-operated system or device, especially during the above-mentioned static modes of operation.

Accordingly, the present invention provides an improved pneumatic control system selectively deactuable and actuable for controlling movement of the armature of a pneumatically-operated device between first and second working positions, respectively, with the control system having a control air inlet port connected to a source of pressurized control air, at least one exhaust outlet port, at least first and second supply ports for selectively supplying control air to forcibly actuate the pneumatically-actuated armature to the first and second working positions, respectively, and a pilot air inlet port connected to a selectively actuable and deactuable source of pressurized pilot air for selectively actuating and deactuating, respectively, the control system. The control system includes a first control valve device or component that is deactuated when the control system is deactuated for supplying control air from the inlet to the first supply port and for blocking the first supply port from the exhaust port, thus causing the armature to move to the first working position. When such first control valve is actuated, in response to actuation of the control system, it blocks the flow of control air from the inlet to the first supply port and exhausts the first supply port. Similarly, a second control valve is provided and is deactuated when the control system is deactuated for blocking the flow of control air from the inlet to the second supply port and for exhausting the second supply port, with the second control valve being actuated in response to control system actuation for supplying control air from the inlet to the second supply port and for blocking the second supply port from the exhaust, thus causing the armature to move to the second working position.

A control system according to the present invention also includes a timing subsystem that is actuable in order to block flow of the control air from the inlet to the first control valve after the expiration of a predetermined time period following deactuation of the first control valve, thus serving to hold the armature of the pneumatically-operated device in the first working position without the need for continuing to supply control air to the first supply port. Such timing subsystem is deactuated, in response to a control air pressure at the first supply port below a predetermined pressure level, thus allowing control air to be supplied from the inlet to the first control valve. Preferably, the timing subsystem includes a pneumatically-actuated timing valve having a pneumatic actuator, with the timing valve being deactuable for supplying control air from the inlet port to the first control valve and actuable for blocking flow of control air from the inlet to the first control valve. In addition, a flow timer device, which is preferably a timing orifice, is provided and connected in fluid communication between the first supply port and the actuator of the timing valve for supplying control air to the actuator of the timing valve at a predetermined flow rate in order to actuate the timing valve after the above-mentioned predetermined time period.

The preferred control system further includes a check valve in fluid communication with the first supply port for blocking flow through the check valve from the first supply port to the actuator of the timing valve, but freely allowing flow through the check valve from the actuator of the timing valve to the first supply port. Such check valve and the above-mentioned preferred timing orifice are connected in parallel fluid communication between the first supply port and the actuator of the timing valve, and thus work together to cause control air to flow from the first supply port to the actuator of the timing valve only through the timing orifice, while freely allowing flow from the actuator of the timing valve to the system exhaust when the first control valve is actuated in order to exhaust the first supply port.

These features, among other optional features described below that can be incorporated into a control system according to the present invention, serve to enhance the efficient energy usage of the overall system by stabilizing the operation of the control system at a predetermined pressure level necessary to maintain certain static conditions in the pneumatically-operated device, while still providing for full line control air pressure when dynamic portions of the operation are required. In addition, such pneumatic control systems according to the present invention compensate for any leakage occurring in the pneumatically-operated device, or related pneumatic systems, by the use of full line control air pressure only when needed to preserve the proper operating functions of the overall system.

Additional objects, advantages, and features of the present invention will become apparent from the following description and the appended claims, taken in conjunction with the accompanying drawings.

DETAILED DESCRIPTION OF THE PREFERRED EMBODIMENTS

Figure 1:
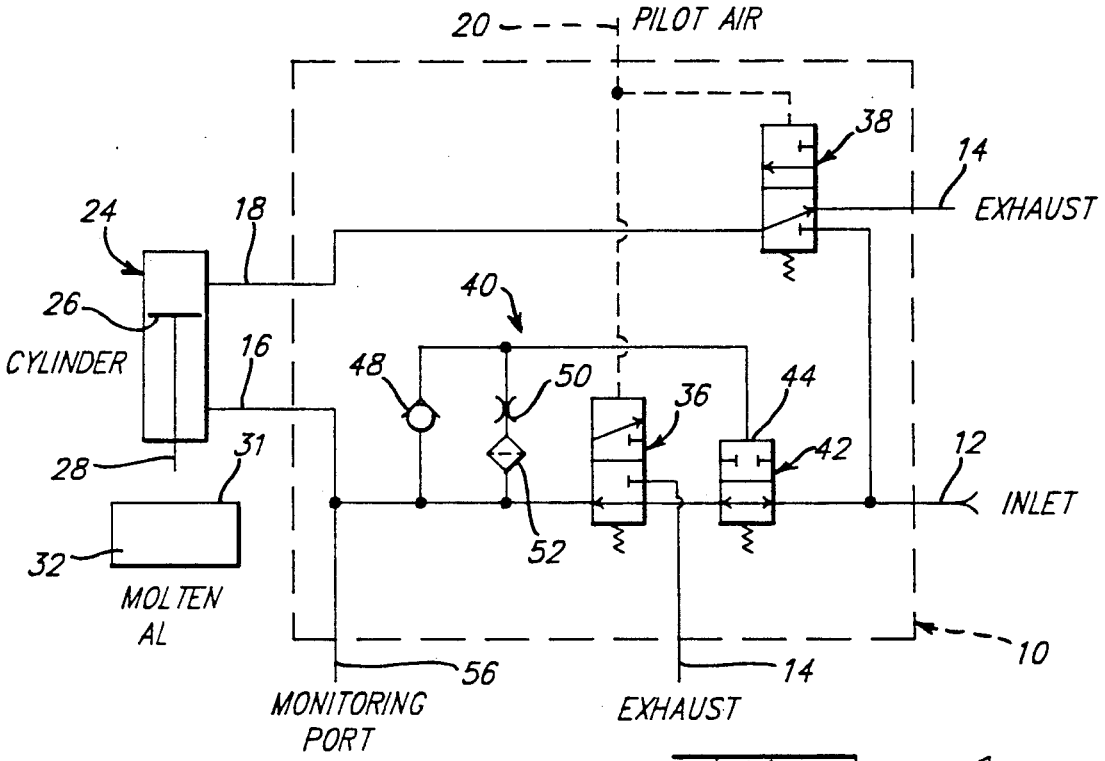
FIG. 1 is a schematic or diagrammatic illustration of a pneumatic control system according to the present invention, with the control system being used to control the operation of an exemplary pneumatic cylinder having an armature connected to a breaker member extendable into, and retractable from, a molten mass of aluminum for breaking up slag in an aluminum processing operation, with the control system being illustrated in FIG. 1 in a mode for retracting the breaker member by way of the pneumatic cylinder.

FIGS. 1 through 11 illustrate various exemplary embodiments of a pneumatic control system according to the present invention, as applied in a pneumatically-controlled system for selectively extending a breaker member into, and retracting such breaker member from, a molten mass of aluminum in order to break up crust in an aluminum processing operation. Such application is, of course, shown merely for purposes of exemplary illustration, and one skilled in the art will readily recognize, from the discussion herein, taken along with the accompanying drawings and claims, that the principles of the present invention are equally applicable in a wide variety of other applications, as well as in aluminum processing operations other than those shown for purposes of illustration in the drawings. In addition, one skilled in the art will readily recognize that the various components of a pneumatic control system according to the present invention can be arranged in a variety of different ways, including separate components interconnected with one another as a system, as well as an integrated block or mechanism having the various functional components of the present invention incorporated therein.

Figure 2:
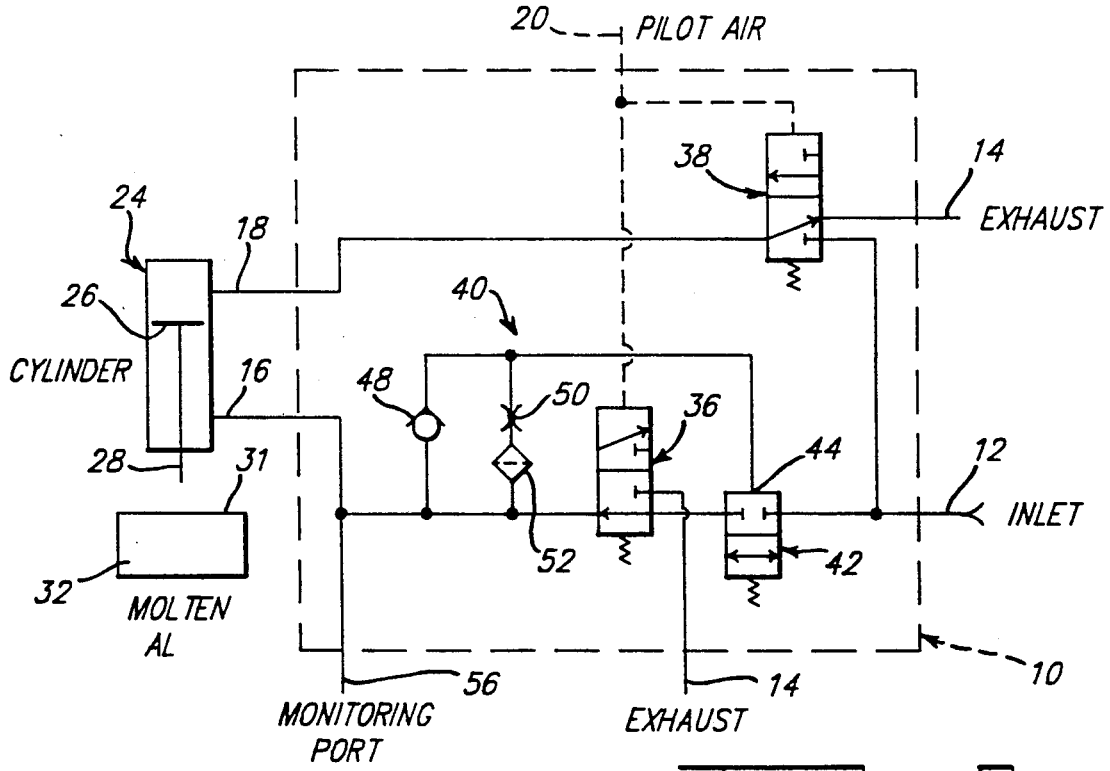
FIG. 2 is a schematic or diagrammatic view similar to that of FIG. 1, but illustrating the control system operation in a static mode wherein the breaker member is held in a stationary, retracted position.
Figure 3:
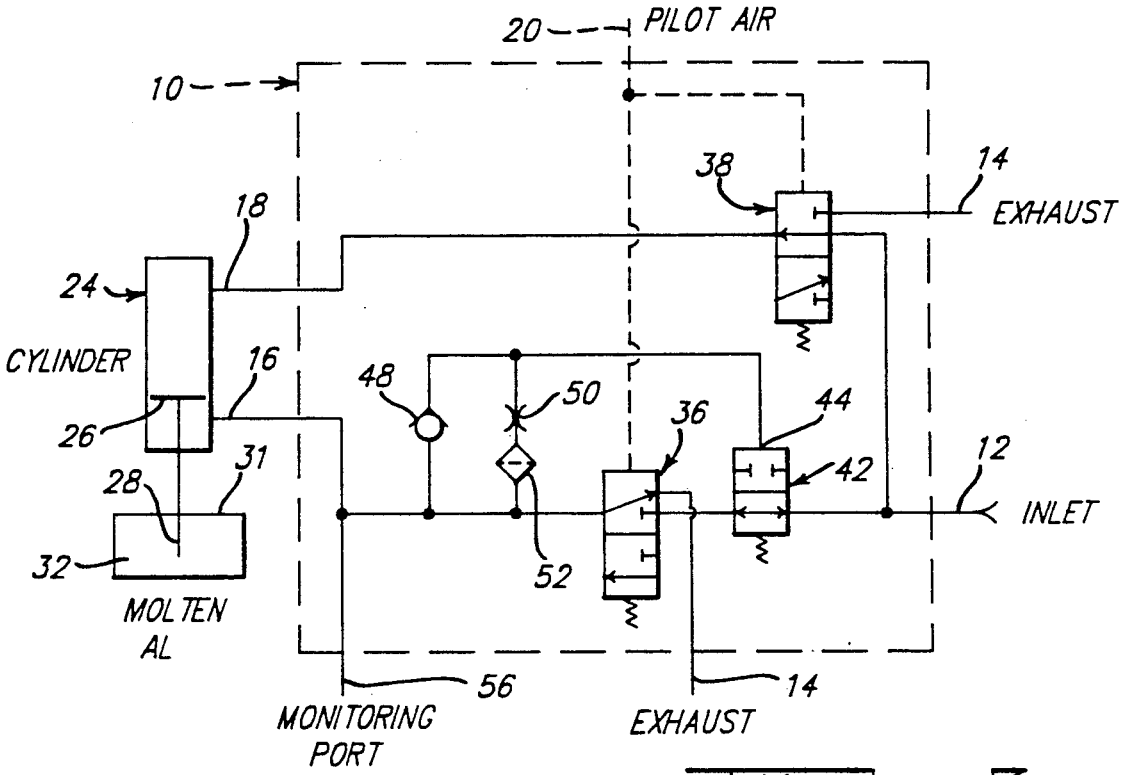
FIG. 3 is a schematic or diagrammatic view of the control system of FIGS. 1 and 2, but illustrating the control system in an operating mode for extending the breaker member into the molten mass of aluminum.

In FIGS. 1 through 3, an exemplary pneumatic control system 10 includes a control air inlet port 12 connectable to a source of pressurized control air, one or more exhaust ports 14, at least first and second supply ports 16 and 18, respectively, and a pilot air inlet port 20 connectable to a source of pressurized pilot air. The pneumatic control system 10 is illustrated in the drawings as applied for controlling the operation of an exemplary pneumatic cylinder 24, with the cylinder 24 typically including a movable piston 26 interconnected with a work-performing member or armature, such as the breaker member 28. In this regard, it should be emphasized that the breaker member 28, which is used in the exemplary illustrative application for breaking up a crust 31 on a mass 32 of molten aluminum, can be any of a number of such breaker devices or members, including a so-called "point feeders", "point breakers", or "bar-breakers", for example.

The pneumatic control system 10 preferably includes a first control valve 36 and a second control valve 38, both of which have their respective inlets connected in fluid communication with the control air inlet port 12. Similarly, the first and second control valves 36 and 38, respectively, have their respective outlets in fluid communication with the first supply port 16 and the second supply port 18, respectively.

The preferred pneumatic control system 10 also includes a timing subsystem 40, having a pneumatically-actuated timing valve 42 with a pneumatic actuator portion 44 thereon, with the timing valve 42 being in fluid communication between the control air inlet 12 and the above-mentioned first control valve 36. A check valve 48 is preferably provided in the timing subsystem 40 and is connected in fluid communication between the first supply port 16 and the pneumatic actuator portion 44 of the timing valve 42. Similarly, a preferred filter 52 and a preferred timing orifice 50 are provided in fluid communication between the first supply port 16 and the pneumatic actuator portion 44 of the timing valve 42, with the check valve 48 and the timing orifice 50 providing such respective fluid communication in parallel with one another. By such an arrangement, flow from the first supply port 16 to the pneumatic actuator 44 can only occur through the timing orifice 50, which is sized to restrict such flow to a predetermined flow rate, while flow from the pneumatic actuator 44 to the first supply port 16 (and thus back to the first control valve 36) is allowed to freely flow without substantial restriction through the check valve 48. Optionally, the control system 10 can include a monitoring port 56 connected in fluid communication with the first supply port 16 and connectable to a gauge or other monitoring apparatus for monitoring the holding pressure required for holding the breaker member 28 in a static position, or for monitoring leakage of the overall system or other fluid parameters of interest.

The nature, function, and operation of the primary components (the control valves 36 and 38, the timing valve 42, and the timing orifice 50), as well as the various peripheral components discussed above, are best described in the context of a description of the system operation, with reference to FIGS. 1 through 3. In FIG. 1, the pneumatic control system 10 is illustrated in a deactuated condition for retracting the breaker member 28, once the control air inlet port 12 is provided with a supply of pressurized control air. The deactuated timing valve 42 in FIG. 1, which is essentially a two-way, normally open valve, is in its open position providing fluid communication between the control air inlet port 12 and the first control valve 36. Similarly, the deactuated first control valve 36, which is essentially a three-way, normally-open valve, is in its open position for supplying pressurized control air to the first supply port 16, and for blocking flow from the first supply port 16 to the exhaust port 14, in order to forcibly urge the piston 26 of the pneumatic cylinder 24, and thus the breaker member 28, to a retracted position wherein the breaker member 28 is retracted from the molten aluminum 32. Accordingly, the deactuated second control valve 38, which is essentially a three-way, normally-closed valve, is in its closed position for providing fluid communication between the second supply port 18 and for blocking flow from the inlet port 12 to the second supply port 18.

In accordance with the present invention, it has been found that the control air pressure necessary to hold the pneumatic cylinder 24 and the breaker member 28 in a static, retracted position is approximately thirty percent to approximately forty percent of the control air pressure at the control air inlet 12 necessary to dynamically retract or extend the piston 26 and the breaker member 28. In a typical, exemplary or illustrative application of the present invention, such as that shown in the drawings, the line or inlet control air pressure is approximately 90 psig, with the necessary "holding" control air pressure being approximately 38 psig. Thus, once the deactuated timing valve 42 and the deactuated first control valve 36 have provided sufficient retracting pressure to retract the breaker member 38, as determined by a predetermined period of time for which the timing orifice 50 has been appropriately sized, sufficient flow through the timing orifice 50 occurs to enable the pneumatic actuator 44 to actuate the timing valve 42 to its closed position, as illustrated in FIG. 2, thus blocking off fluid communication between the control air inlet 12 and the first control valve 36. Accordingly, the control air pressure necessary to maintain the breaker member in its retracted position is contained or trapped in the control system 10 for purposes of maintaining the breaker member 28 in its retracted position.

During the holding or statically retracted condition illustrated in FIG. 2, the pressure at the first supply port 16 can decay as a result of leakage in the pneumatic cylinder 24, or in other related subsystems, with such pressure decay being communicated through the timing orifice 50 and eventually resulting in sufficient pressure decay to a predetermined low pressure level that allows the timing valve 42 to deactuate to its open position. However, as soon as such deactuation of the timing valve 42 occurs, full line control air pressure from the control air inlet 12 is again communicated to the first supply port 16, by way of the first control valve 36, in order to repressurize the system and continue to maintain the breaker member 28 in its retracted position. As such deactuation or opening of the timing valve 42 begins to occur, such downstream pressure restoration is also communicated through the timing orifice 50 to the pneumatic actuator 44 of the timing valve 42. This arrangement results in the opening of the timing valve 42 until it supplies sufficient control air pressure to equalize and hold the breaker member 28 in a static position or to compensate for the leakage or other condition that has caused pressure decay at the first supply port 16. Thus, as can be readily appreciated, the timing subsystem 40 functions to conserve energy required to operate the system in such a holding or retracted static mode, with compensation for system leakage or other conditions causing pressure decay being delayed until the pressure at the first supply port 16 decays to below a predetermined pressure level deemed necessary for maintaining the retracted or static position of the breaker member 28. These functions are accomplished by the present invention without continuously supplying full control air pressure to the supply port.

When dynamic movement of the breaker member 28 to its extended position, projecting into the molten aluminum 32 is desired, the pneumatic control system 10 is actuated, by way of conventional controls, to supply pressurized pilot air to the pilot air inlet port 20, thus actuating the first control valve 36 and the second control valve 38. In such an operating condition, illustrated in FIG. 3, the second control valve 38 is moved to its open position, providing fluid communication for pressurized control air therethrough from the control air inlet 12 to the second supply port 18 to cause the piston 26 and the breaker member 28 being forcibly urged toward their extended position. Simultaneously, in order to accommodate such dynamic extension of the piston 26 and the breaker member 28, the actuated first control valve 36 is moved to its exhaust conditin illustrated in FIG. 3, for providing fluid communication from the first supply port 16 to the exhaust port 14, as well as from the pneumatic actuator 44 of the timing valve 42 (through the check valve 48) to the exhaust port 14. As a result, the timing valve 42 is deactuated to its open position, ready for subsequent deactuation of the control system 10 for purposes of retracting the piston 26 and the breaker member 28.

After the breaker member 28 has adequately extended into the molten aluminum 32 for purposes of breaking up crust therein, the control system 10 is deactuated, by way of exhausting or cutting off supply of pressurized pilot air to the pilot air inlet 20, which can be accomplished by way of conventional controls. As a result, the control system 10 returns to the deactuated condition illustrated diagrammatically in FIG. 1, with the first and second control valves 36 and 38, respectively, as well as the timing valve 42 in their respective deactuated conditions. At this point in the operation, the operating cycle can be repeated, or the entire system can be shut down, after retraction of the piston 26 and the breaker member 28.

Although not expressly illustrated in the drawings, one skilled in the art will now readily recognize that the extended condition of the cylinder 24, or other such pneumatically-operated device, can also be maintained in a static condition, with accompanying compensation for leakage, by way of the provision of a second timing subsystem, substantially similar to that described above in connection with the timing subsystem 40, in conjunction with the second control valve 38. By providing such a second timing subsystem, such "holding" static operations can be performed in both the extended and the retracted conditions of the pneumatic cylinder 24, if such a timing subsystem is provided in conjunction with both the first and second control valves 36 and 38, respectively, or such "holding" condition can be maintained in conjunction with either one of these control valves if only one of such timing subsystems is provided in conjunction with the desired control valve. Furthermore, one skilled in the art will readily recognize that the pneumatic control system according to the present invention can also be advantageously employed in applications where more than two supply ports are required for controlling the operation of pneumatically-operated devices having multiple pneumatic chambers, multiple pistons, or different required operating pressures such that more than two supply ports are required.

Figure 4:
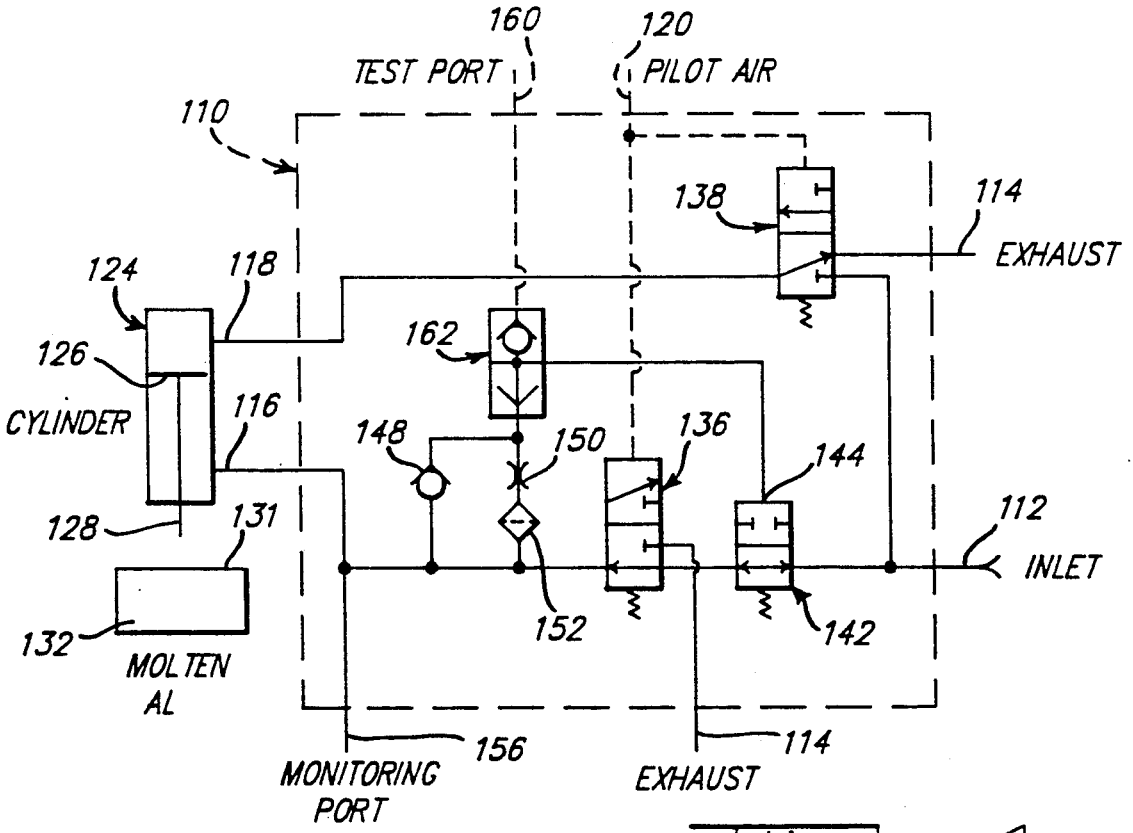
FIG. 4 is a schematic or diagrammatic representation similar to that of FIGS. 1 through 3, but illustrating an alternate embodiment of the present invention, wherein the control system includes a subsystem for testing proper system operation, with the testing subsystem including a test port and a shuttle valve selectively actuable and deactuable for performing such testing operations.
Figure 5:
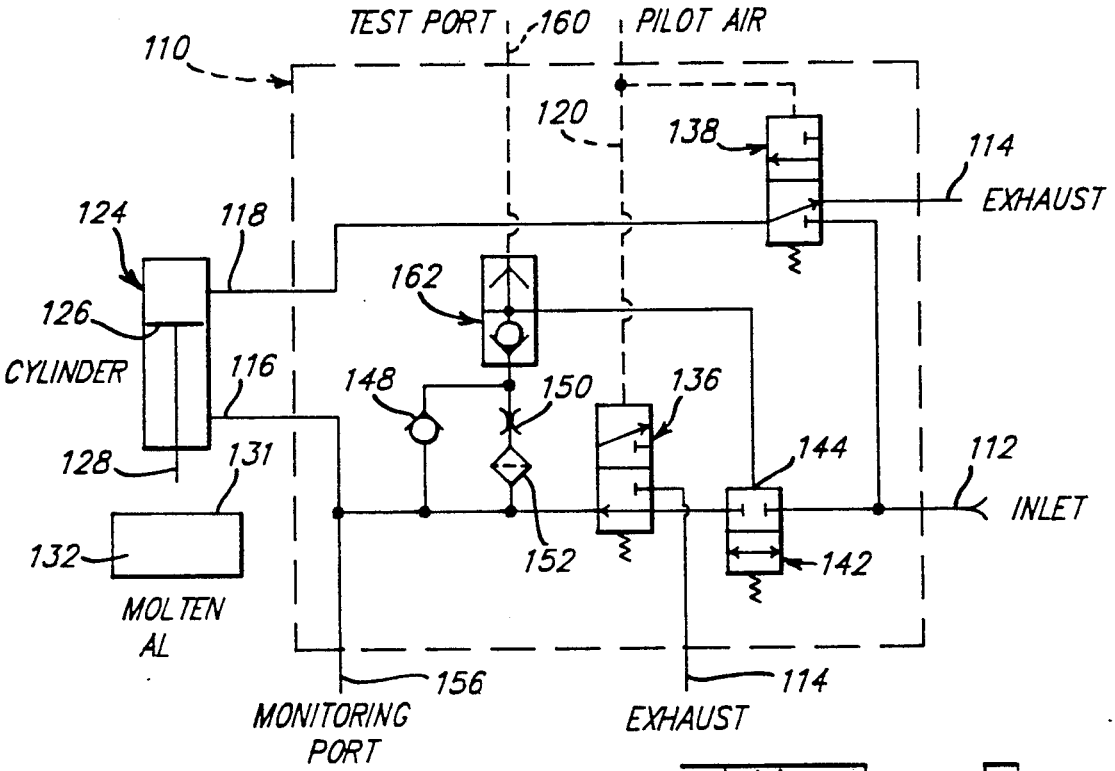
FIG. 5 is a schematic or diagrammatic representation of the control system of FIG. 4, illustrating the system in a testing mode.

FIGS. 4 and 5 illustrate an alternate embodiment of, or a variation on, the control system 10 of FIGS. 1 through 3, with the alternate control system 110 of FIGS. 4 and 5 functioning in a similar manner, and with similar components, as that of the control system 10, but with the exceptions discussed below. Accordingly, corresponding (or identical) components of the control system 110 shown in FIGS. 4 and 5 are indicated by reference numerals that correspond to those of the corresponding components in the control system 10, but with those of FIGS. 4 and 5 having one-hundred prefixes.

The control system 110 diagrammatically illustrated in FIGS. 4 and 5 is substantially the same as the previously-described control system 10 with the exception of the provision of a test port 160 and a shuttle valve 162 connected in fluid communication with the test port 160 and the pneumatic actuator 144 of the timing valve 142, at a location between the pneumatic actuator 144 and the timing orifice 150. With the shuttle valve 162 in the position or condition illustrated in FIG. 4, which occurs when no pressurized air is admitted to the test port 160, the control system 110 functions in the same manner as that described above in connection with the control system 10 illustrated in FIGS. 1 through 3. However, as illustrated in FIG. 5, when it is desired to test various operations of the overall system, including the holding pressure needed to maintain the cylinder 124 in its static, retracted condition, or to monitor or test for leakage by way of the monitoring port 156, sufficient pressurized air is admitted to the test port 160 so as to cause the shuttle valve 162 to move to the position or condition illustrated in FIG. 5. This results in pressurized air from the test port 160 then being blocked off from the timing orifice 150, but admitted or communicated to the pneumatic actuator 144 in order to actuate the timing valve 142 and block off communication of pressurized control air from the control air inlet 112 to the first control valve 136 and the first supply port 116. In this condition, the above-mentioned testing and/or monitoring of pressure, leakage, or other fluid parameters can be performed.

When such testing operations have been completed, the pressurized air at the test port 160 is exhausted or cut off, thus allowing or causing the shuttle valve 162 to revert to the condition illustrated in FIG. 4, in order to return the system to normal operation. In this regard, one skilled in the art will readily recognize that such testing operations can be accomplished manually, or by way of computerized or other pneumatic controls for periodic testing and for providing appropriate alerting of personnel when the overall system leakage or other parameters have reached unacceptable conditions requiring maintenance or other responsive actions.

Figure 6:
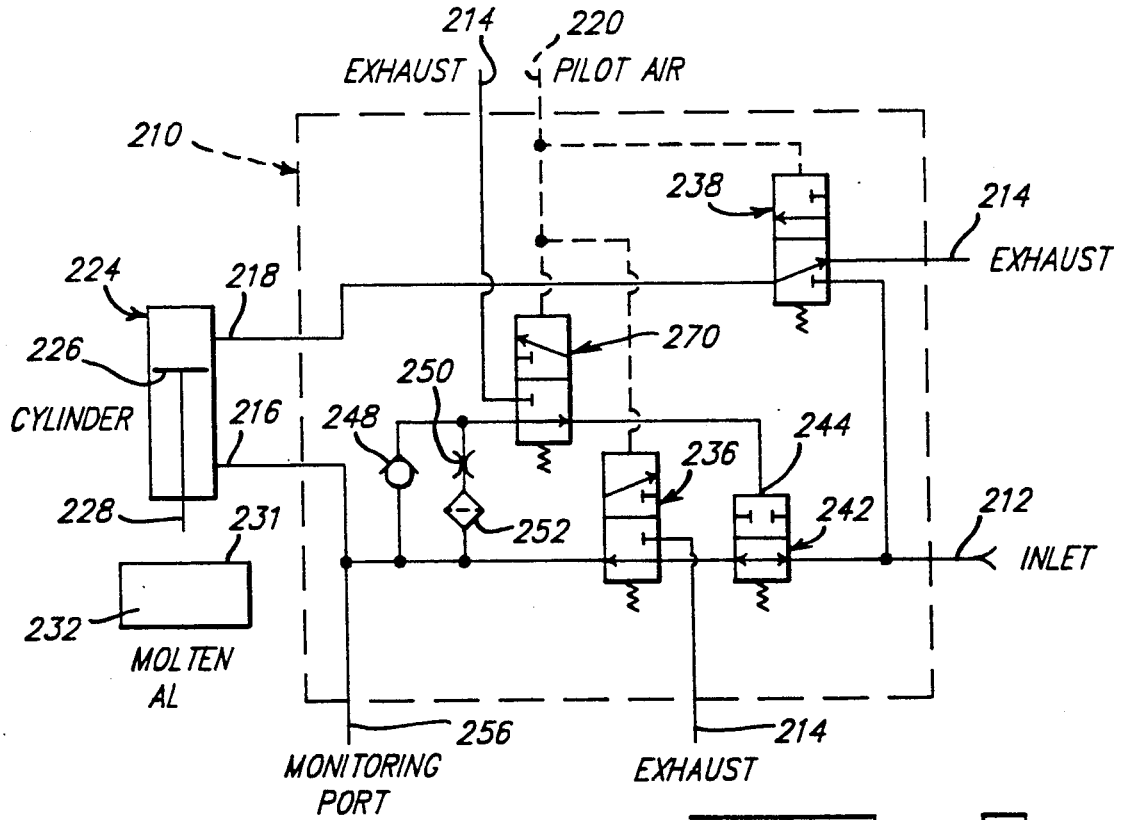
FIG. 6 schematically or diagrammatically illustrates still another variation on, or alternate embodiment of, a control system according to the present invention, including an exhaust valve actuable and deactuable in response to system actuation and deactuation, respectively, with the embodiment of FIG. 6 being particularly applicable in operations where heavier bar and breaker member retraction are required or desirable.
Figure 7:
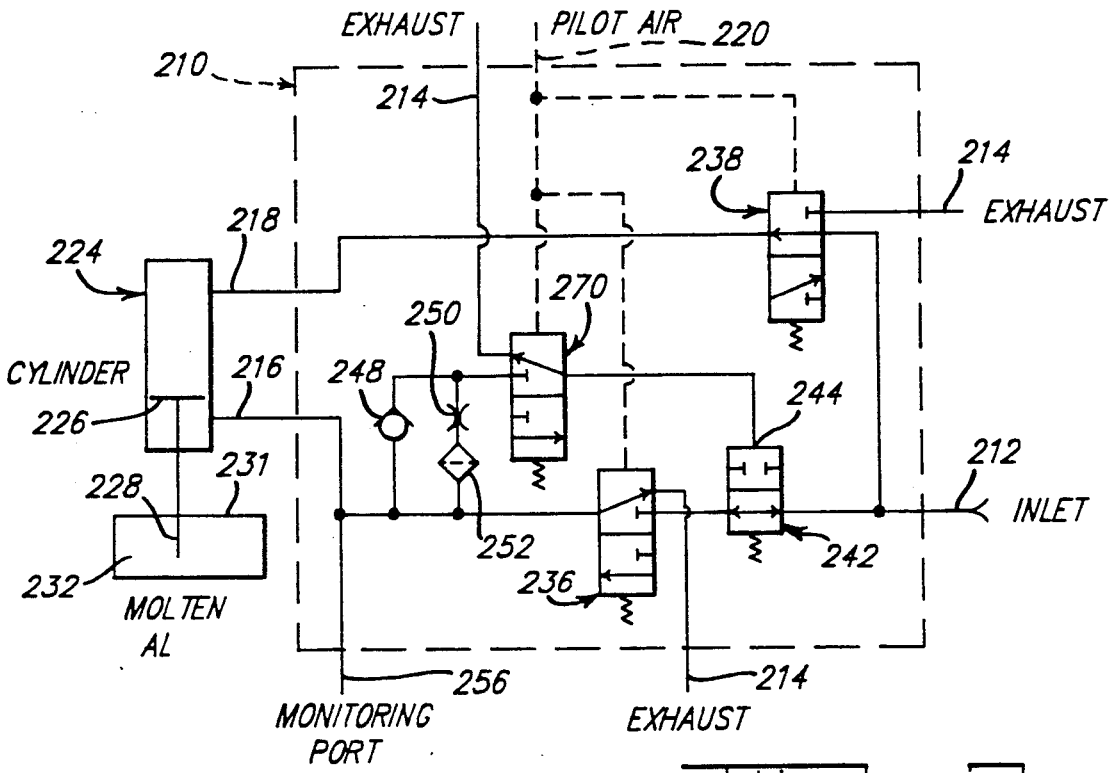
FIG. 7 is a schematic or diagrammatic illustration of the embodiment of FIG. 6, illustrating the exhaust valve in its exhaust mode.

FIGS. 6 and 7 illustrate still another variation on, or alternate embodiment of, the present invention, wherein the exemplary pneumatic control system 210 is substantially similar to the pneumatic control system 10 discussed above in conjunction with FIGS. 1 through 3, but with the exceptions discussed below. Accordingly, components of the control system 210 that correspond to those of the control system 10 are indicated by the same reference numerals, but with the reference numerals of FIGS. 6 and 7 having two-hundred prefixes.

In various applications of the present invention, it is desired or required that the work-performing member, or the breaker member 228, be more quickly retracted or extended, or otherwise dynamically moved. An example of such an application is an aluminum processing operation that requires a relatively large breaker member, commonly referred to as a "breaker bar". When such quicker dynamic response is required, the supply portions of the control system that supply and exhaust pressure to and from the pneumatically-operated device can be equipped with a pneumatically-actuable and deactuable exhaust valve, such as the exhaust valve 270 illustrated in FIGS. 6 and 7 for the pneumatic control system 210.

As is schematically represented in FIGS. 6 and 7, the exhaust valve 270 has a pneumatic actuator connected in communication with the pilot air inlet 220 for selective actuation and deactuation in response to respective actuation and deactuation of the control system 210 in a manner described above. Thus, as illustrated in FIG. 6, when the control system 210 is deactuated, the exhaust valve 270, which is essentially a three-way, normally open valve, is deactuated and thus provides for normal fluid communication between either the timing orifice 250 or the check valve 248 and the pneumatic actuator 244 of the timing valve 242. When the exhaust valve 270 is in such a deactuated condition, the pneumatic control system 210 functions as described above in connection with previously-described embodiments of the invention.

When the control system 210 is actuated, as illustrated in FIG. 7, the exhaust valve 270 is similarly actuated to a position wherein the pneumatic actuator 244 of the timing valve 242 is exhausted (through the exhaust valve 270) by way of the exhaust port 214. As a result of such exhausting of the pneumatic actuator 244, the timing valve 242 is deactuated, coincident with the exhausting of the first supply port 216, in order to more quickly return the timing valve 242 to its "ready" or "open" condition. Such rapid exhausting of the pneumatic actuator 244 of the timing valve 242 greatly contributes to the rapid exhausting of the first supply port 216, since no residual pressure from the pneumatic actuator 244 is required to flow through the first control valve 236 to the exhaust port 214 along with the pressurized control air from the first supply port 216 flowing through the first control valve 236 to the exhaust port 214. Thus, the piston 226 and the breaker member 228 can be more rapidly extended into the molten aluminum 232, or other corresponding operations can be performed in other applications of the present invention in a more rapid manner. In addition, the use of the exhaust 270 in this embodiment not only quickens the exhaust time, but also increases the exhaust flow which is needed in some applications having relatively large bars or breakers.

In this regard, it should be noted that the features of the previously-discussed pneumatic control system 110, discussed above in connection with FIGS. 4 and 5, can be employed in conjunction with the exhaust valve 270 illustrated in FIGS. 6 and 7. Further in this regard, it should be noted that the features of the various embodiments of the invention shown in FIGS. 1 through 11 are not mutually exclusive from one another, and thus can be combined with one another, or substituted for one another, in order to arrive at various combinations, sub-combinations, or permutations of these features in accordance with the present invention in order to address specific needs or specific applications.

Figure 8:
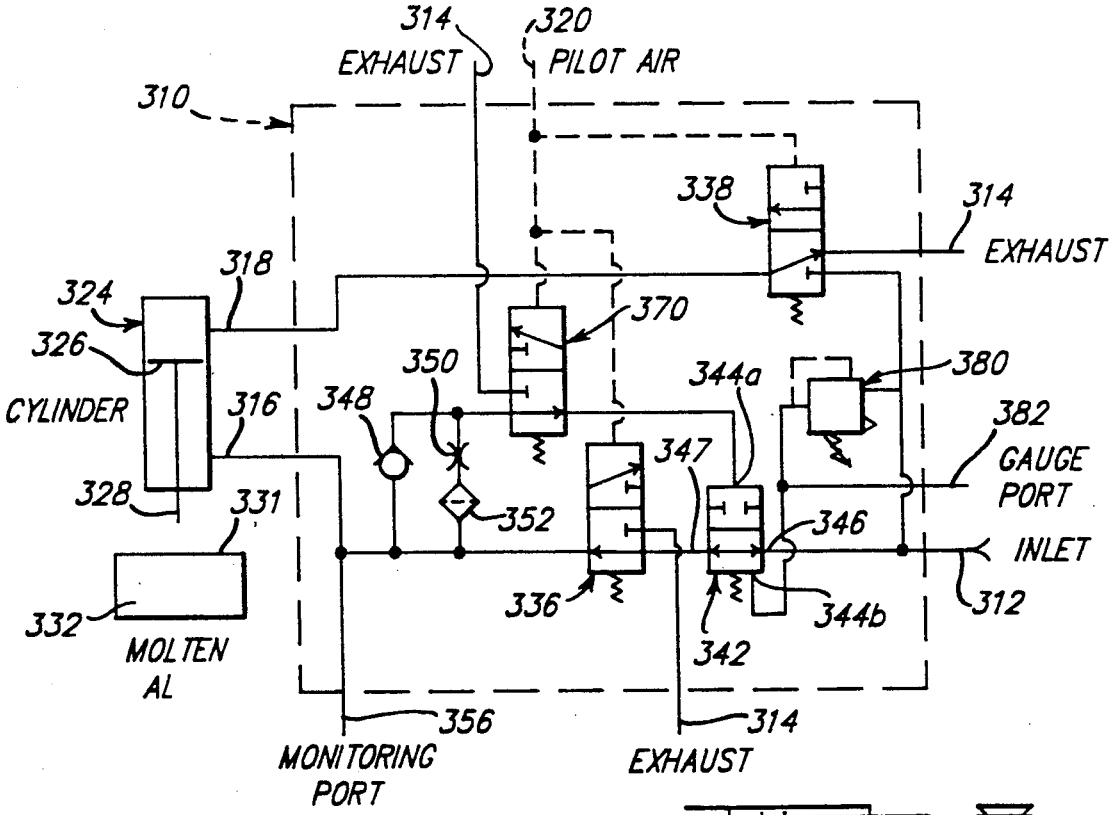
FIG. 8 is a schematic or diagrammatic representation of still another alternate embodiment of the present invention, which is similar to that of FIGS. 6 and 7, but which also includes a regulator subsystem for carefully controlling and monitoring the pressure required for holding the pneumatically-actuated breaker member in a static position.
Figure 9:
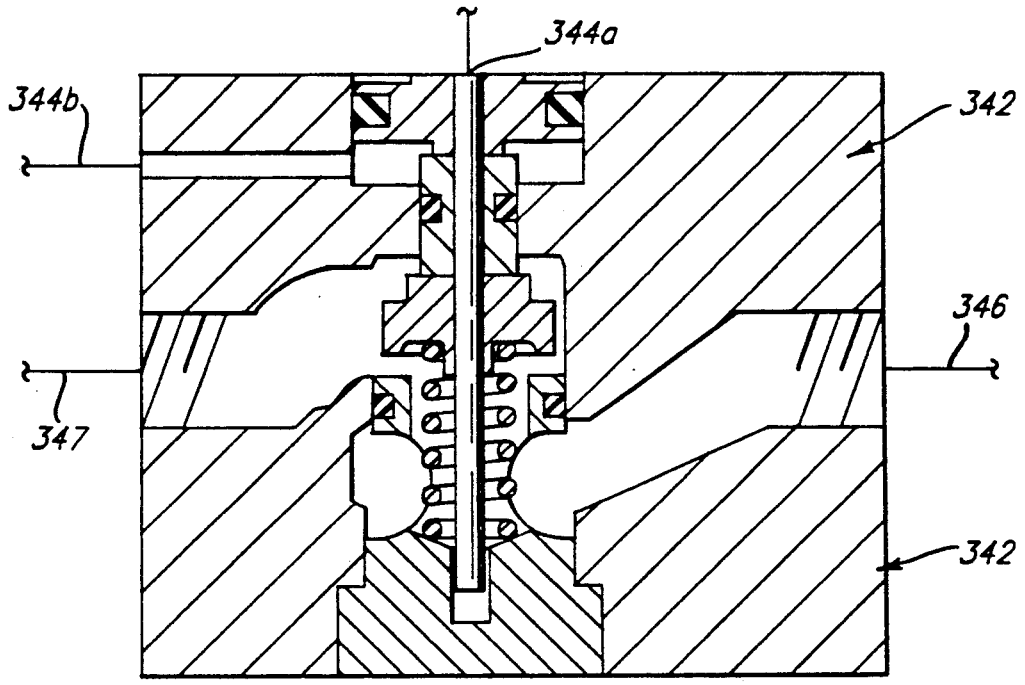
FIG. 9 is a representative, exemplary illustration of a regulated timing valve of the system illustrated in FIG. 8, but also applicable in the other embodiments of the invention.

FIGS. 8 and 9 illustrate still another optional or alternate embodiment of the present invention, with the features disclosed in conjunction with FIGS. 8 and 9 being capable of being incorporated with one or more of the various features or versions of the present invention described herein. Because the alternate embodiment depicted schematically or diagrammatically in FIGS. 8 and 9 is similar to that of FIGS. 6 and 7, with the exceptions described below, corresponding (or identical) components of the control system 310 shown in FIGS. 8 and 9 are indicated by reference numerals that correspond to those of the corresponding components of the control systems 10, 110, and 210, but with the reference numerals of FIGS. 8 and 9 having three-hundred prefixes.

In addition to the components discussed above, the control system 310 includes a self-relieving regulator 380 connected for fluid communication between the inlet port 312 and the pneumatic actuator portion **344*b* of the timing valve 342. The pneumatic actuator portion 344*b* is capable of maintaining the timing valve 342 in its open position in opposition to the closing actuating force of the pneumatic actuator portion 344*a*. An exemplary schematic representation of a valve or valve component suitable for use as the timing valve 342 is illustrated in FIG. 9. It should be recognized, however, that such timing valve 342 can be a separate component interconnected with other components in the control system 310, or can merely be integrated with other such functional components in an integrated block containing the functional components of the control system 310**.

The control system 310 shown in FIGS. 8 and 9 functions in a manner substantially the same as that described above in connection with the control system 210 of FIGS. 6 and 7, except that the regulator 380 functions to communicate control air pressure from the control air inlet 312 therethrough to the pneumatic actuator portion **344*b* of the timing valve 342, thus holding the timing valve 342 in its deactuated open position until a predetermined, preset pressure is sensed by the regulator 380. When such predetermined, preset control air pressure, which is indicative of the control air pressure at the first supply port 316, is sensed or detected by the regulator 380, the regulator 380 automatically self-relieves or exhausts in order to relieve or exhaust pressure from the pneumatic actuator port 344*b* of the timing valve 342, thus allowing the timing valve 342 to function in its normal manner, as discussed above. Regulators of the same functional type as the regulator component 380** are well-known in the art.

By such an arrangement, as depicted in FIGS. 8 and 9, the self-relieving regulator 380 can be used to carefully control any preselected "holding" pressure that is desired at the first supply port 316. In addition, by providing an optional gauge port 382, such preselected or predetermined "holding" pressure can be monitored, by way of a gauge, other monitoring devices, or interconnected with digital or other related controls for operating the system in a desired manner.

It should be noted that the exemplary timing valve 342 depicted in FIGS. 8 and 9 can be employed in any of the versions of the invention, with the only difference in FIG. 8 being that air pressure is supplied to port **344*b* in FIG. 8, while in the other versions of the invention this port 344*b*** is vented to the atmosphere.

Figure 10:
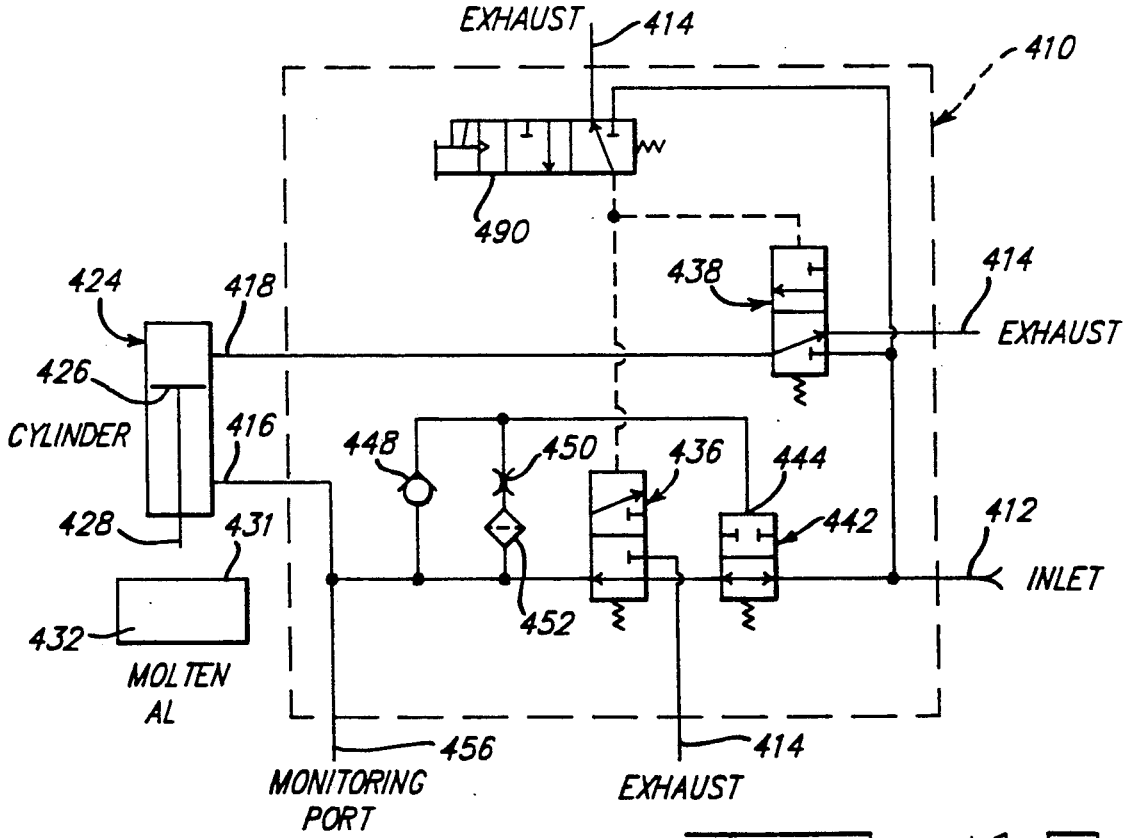
FIG. 10 is a schematic or diagrammatic representation of a further optional or alternate embodiment of the present invention, with a pilot air system that is electrically actuable and deactuable, either locally or remotely, by way of an electric solenoid-operated pilot air valve.
Figure 11:
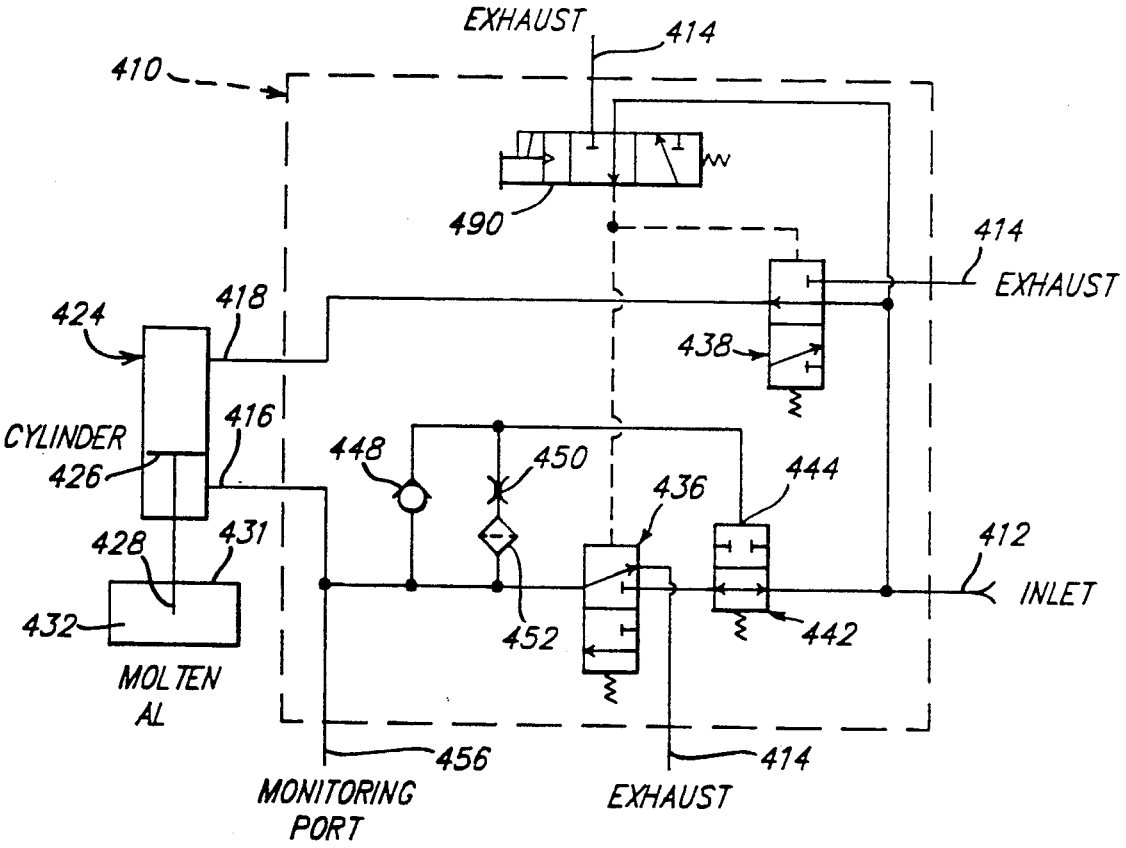
FIG. 11 is a schematic or diagrammatic illustration of the system of FIG. 10, illustrating the solenoid-operated pilot valve in an actuated condition for actuating the control system.

In FIGS. 10 and 11, the control system 410 is substantially similar to the control systems described above, except for the provision of an electrically-operated solenoid pilot valve 490, which can be employed in conjunction with any of the various control system arrangements described herein. Because of such similarities, components of the control system 410 illustrated in FIGS. 10 and 11 are indicated by reference numerals that correspond to corresponding components of the previously-described control systems, except that the reference numerals in FIGS. 10 and 11 have four-hundred prefixes.

The electrically-operated solenoid pilot valve 490 can be a three-way, normally-closed valve, for example, and is connected in fluid communication between the actuating components of the first and second control valves 436 and 438, respectively, and the source of pressurized pilot air. In this regard, the source of pressurized pilot air can be a separate pilot air system, or as shown for purposes of example in FIGS. 10 and 11, such source of pressurized pilot air can be the control air inlet port 412. As shown in FIG. 10, the control system 410 is in its deactuated condition, with the normally-closed solenoid pilot valve 490 also in its deactuated condition providing fluid communication between the actuating components of the first and second control valves 436 and 438, respectively, and the exhaust port 414. Also in such deactuated condition, the solenoid pilot valve 490 blocks off fluid communication between the inlet port 412 and the actuating components of the control valves 436 and 438.

When it is desired to actuate the control system 410, in order to provide for functions or operations described above, the preferred electrically-operated solenoid pilot valve 490 is actuated, either locally or remotely, to the condition illustrated in FIG. 11. In its actuated condition, the solenoid pilot valve 490 provides fluid communication from the control air inlet 412 to the actuating components of the first and second control valves 436 and 438, respectively, while blocking off fluid communication from these actuating components to the exhaust port 414. The admission of control air (or other pressurized pilot air from an alternate source) to the actuating components of the control valves 436 and 638 causes actuation of the control valves 436 and 438, with the control system 410 then functioning in a manner described above in conjunction with other embodiments of the invention. Thus, the provision of the preferably electrically-operated solenoid pilot valve 490 allows for enhanced convenience for actuating and deactuating the control system 410, as well as providing for optional integration with other related controls or subsystems.

The foregoing discussion discloses and describes merely exemplary embodiments of the present invention for purposes of illustration only. One skilled in the art will readily recognize from such discussion, and from the accompanying drawings and claims, that various changes, modifications, and variations can be made therein without departing from the spirit and scope of the invention as defined in the following claims.

What is claimed is:

1. A pneumatic control system for selectively controlling the movement of a pneumatically-operated device between first and second working positions, said control system having control air inlet port connected to a source of pressurized control air, an exhaust port, first and second supply ports for selectively supplying control air to forcibly urge the device to the first and second working positions, respectively, and a pilot air inlet port connected to a selectively actuable and deactuable source of pressurized pilot air for selectively actuating and deactuating said control system, said control system further comprising:

first control valve means deactuated when said control system is deactuated for supplying said control air from said inlet port to said first supply port and for blocking said first supply port from said exhaust port, said first control valve means being actuated when said control system is actuated for blocking flow of said control air from said inlet port to said first supply port and for exhausting said first supply port to said exhaust port;

second control valve means deactuated when said control system is deactuated for blocking flow of said control air from said inlet port to second supply port and for exhausting said second supply port to said exhaust port, said second control valve means being actuated when said control system is actuated for supplying said control air from said inlet port to said second supply port and for blocking said second supply port from said exhaust port; and timing means actuated for blocking flow of said control air from said inlet port to said first control valve means after the expiration of a predetermined time period after deactuation of said first control valve means in order to hold the device in the first working position without continuing to supply control air to said first supply port, said timing means being deactuated for supplying said control air from said inlet port to said first control valve means in response to a control air pressure at said first supply port below a predetermined pressure level.

2. A pneumatic control system according to claim 1, wherein said timing means includes a pneumatically-actuated timing valve means having a pneumatic actuator thereon, said timing valve means being deactuable for supplying said control air from said inlet port to said first control valve means, said timing valve means being actuable for blocking flow of said control air from said inlet port to said first control valve means, and flow timer means connected in fluid communication between said first supply port and said actuator of said timing valve means for supplying control air to said actuator of said timing valve means at a predetermined flow rate in order to actuate said timing valve means after said predetermined time period.

3. A pneumatic control system according to claim 2, wherein said timing means includes a check valve in fluid communication with said first supply port for blocking flow through said check valve from said first supply port to said actuator of said timing valve means and for freely allowing flow through said check valve from the actuator of said timing valve means to said first supply port, said check valve and said timing orifice being connected in parallel fluid communication between said first supply port and said actuator of said timing valve means, thereby causing control air to flow from said first supply port to said actuator of said timing valve means only through said timing orifice, but freely allowing flow from said actuator of said timing valve means to said exhaust port when said first control valve means is actuated for exhausting said first supply port to said exhaust port.

4. A pneumatic control system according to claim 2, wherein said flow timer means includes a timing orifice for allowing flow of control air therethrough at said predetermined flow rate.

5. A pneumatic control system according to claim 4, wherein said timing means includes a check valve in fluid communication with said first supply port for blocking flow through said check valve from said first supply port to said actuator of said timing valve means and for freely allowing flow through said check valve from the actuator of said timing valve means to said first supply port, said check valve and said timing orifice being connected in parallel fluid communication between said first supply port and said actuator of said timing valve means, thereby causing control air to flow from said first supply port to said actuator of said timing valve means only through said timing orifice, but freely allowing flow from said actuator of said timing valve means to said exhaust port when said first control valve means is actuated for exhausting said first supply port to said exhaust port.

6. A pneumatic control system according to claim 2, wherein said timing means is deactuable in response to said control air pressure at said first supply port being below said predetermined pressure level when said first control valve means is actuated for exhausting said first supply port to said exhaust port.

7. A pneumatic control system according to claim 6, wherein said timing means is also deactuable in response to said control air pressure at said first supply port being below said predetermined pressure level when a predetermined amount of leakage has occured in the pneumatically-operated device.

8. A pneumatic control system according to claim 2, further comprising testing means for selectively actuating said timing valve means in order to block flow of said control air from said inlet port to said first control valve means regardless of whether said first control valve means is deactuated, a monitoring port in fluid communication with said first supply port, and monitoring means in fluid communication with said monitoring port for monitoring at least one fluid parameter at said first supply port.

9. A pneumatic control system according to claim 8, wherein said monitoring means is adapted for monitoring any leakage in the pneumatically-operated device.

10. A pneumatic control system according to claim 1, wherein said pneumatically-operated device is a pneumatic cylinder having a piston therein forcibly movable between said first and second working positions, said piston having a work-performing member attached thereto and movable therewith.

11. A pneumatic control system according to claim 10, wherein said work-performing member is forcibly extended into a molten mass of aluminum for breaking up slag therein in an aluminum processing operation when said work-performing member is in said second working position, said work-performing member being withdrawn from said molten mass when in said first working position.

12. A pneumatic control system according to claim 5, further comprising testing means for selectively actuating said timing valve means in order to block flow of said control air from said inlet port to said first control valve means regardless of whether said first control valve means is deactuated, a monitoring port in fluid communication with said first supply port, and monitoring means in fluid communication with said monitoring port for monitoring at least one fluid parameter at said first supply port.

13. A pneumatic control system according to claim 12, wherein said monitoring means is adapted for monitoring any leakage in the pneumatically-operated device.

14. A pneumatic control system according to claim 12, wherein said testing means includes: a test port connected to a selectively actuable and deactuable source of pressurized test air; and shuttle valve means in fluid communication with said test port, said timing orifice, and said actuator of said timing valve means, said shuttle valve means allowing flow of said test air from said test port to said actuator of said timing valve means and blocking flow from said timing orifice to said actuator of said timing valve means when said source of said test air is actuated, and said shuttle valve means allowing flow from said timing orifice to said actuator of said timing valve means and blocking flow from said test port to said actuator of said timing valve means when said source of said test air is deactuated.

15. A pneumatic control system according to claim 1, further comprising a monitoring port in fluid communication with said first supply port, said monitoring port being connectable to monitoring means for monitoring at least one fluid parameter at said first supply port.

16. A pneumatic control system according to claim 15, further comprising testing means for selectively actuating said timing means in order to block flow of said control air from said inlet port to said first control valve means regardless of whether said first control valve means is deactuated, said monitoring means monitoring any leakage in the pneumatically-operated device.

17. A pneumatic control system according to claim 2, further comprising selectively actuable and deactuable exhaust valve means in fluid communication with said first control valve means, said actuator of said timing valve means, and said exhaust port, said exhaust valve means being deactuated when said control system is deactuated for blocking flow therethrough from said actuator of said timing valve means to said exhaust port and for allowing actuation of said timing valve means, and said exhaust valve means being actuated when said control system is actuated for providing flow therethrough from said actuator of said timing valve means to said exhaust port and for allowing deactuation of said timing valve means.

18. A pneumatic control system according to claim 17, wherein said timing means includes a check valve in fluid communication with said first supply port for blocking flow through said check valve from said first supply port to said actuator of said timing valve means and for freely allowing flow through said check valve from the actuator of said timing valve means to said first supply port, said check valve and said timing orifice being connected in parallel fluid communication between said first supply port and said actuator of said timing valve means, thereby causing control air to flow from said first supply port to said actuator of said timing valve means only through said timing orifice, but freely allowing flow from said actuator of said timing valve means to said exhaust port when said first control valve means is actuated for exhausting said first supply port to said exhaust port.

19. A pneumatic control system according to claim 17, wherein said flow timer means includes a timing orifice for allowing flow of control air therethrough at said predetermined flow rate.

20. A pneumatic control system according to claim 19, wherein said timing means includes a check valve in fluid communication with said first supply port for blocking flow through said check valve from said first supply port to said actuator of said timing valve means and for freely allowing flow through said check valve from the actuator of said timing valve means to said first supply port, said check valve and said timing orifice being connected in parallel fluid communication between said first supply port and said actuator of said timing valve means, thereby causing control air to flow from said first supply port to said actuator of said timing valve means only through said timing orifice, but freely allowing flow from said actuator of said timing valve means to said exhaust port when said first control valve means is actuated for exhausting said first supply port to said exhaust port.

21. A pneumatic control system according to claim 17, wherein said timing means is deactuable in repsonse to said control air pressure at said first supply port being below said predetermined pressure level when said first control valve means being actuated for exhausting said first supply port to said exhaust port.

22. A pneumatic control system according to claim 21, wherein said timing means is also deactuable in response to said control air pressure at said first supply port being below said predetermined pressure level when a predetermined amount of leakage has occurred in the pneumatically-operated device.

23. A pneumatic control system according to claim 2, further comprising regulator means for preventing actuation of said timing valve means when said control air pressure at said first supply port is below said predetermined pressure level.

24. A pneumatic control system according to claim 23, wherein said regulator means includes a self-relieving pressure regulator in fluid communication between said inlet port and said actuator of said timing valve means, said regulator providing flow therethrough from said inlet port to said actuator of said timing valve means to oppose said actuation of said timing valve means when said control air pressure at said first supply port is below said predetermined pressure, said regulator self-relieving in order to exhaust flow from said inlet port therethrough when said control air pressure at said first supply port is at or above said predetermined pressure level.

25. A pneumatic control system according to claim 24, further comprising monitoring gauge means for monitoring the pressure of the control air flowing through said regulator to said actuator of said timing valve means.

26. A pneumatic control system according to claim 1, further comprising selectively actuable and deactuable electric solenoid valve means for respectively actuating and deactuating said source of pressurized pilot air in order to respectively actuate and deactuate said control system.

27. A pneumatic control system according to claim 26, wherein said solenoid valve means provides for system-actuating fluid communication therethrough from said source of pressurized pilot air to said first and second control valve means when said solenoid valve means is electrically actuated, said solenoid valve means blocking said system-actuating fluid communication and providing for system-deactuating fluid communication therethrough from said first and second control valve means to said exhaust port when said solenoid valve means is electrically deactuated.

28. A pneumatic control system according to claim 27, wherein said source of pressurized pilot air is said control air inlet port.

29. A pneumatic control system for selectively controlling the movement of a pneumatically-operated device between first and second working positions, said control system having control air inlet port connected to a source of pressurized control air, an exhaust port, first and second supply ports for selectively supplying control air to forcibly urge the device to the first and second working positions, respectively, and a pilot air inlet port connected to a selectively actuable and deactuable source of pressurized pilot air for selectively actuating and deactuating said control system, said control system further comprising:

first control valve means deactuated when said control system is deactuated for supplying said control air from said inlet port to said first supply port and for blocking said first supply port from said exhaust port, said first control valve means being actuated when said control system is actuated for blocking flow of said control air from said inlet port to said first supply port and for exhausting said first supply port to said exhaust port;

second control valve means deactuated when said control system is deactuated for blocking flow of said control air from said inlet port to second supply port and for exhausting said second supply port to said exhaust port, said second control valve means being actuated when said control system is actuated for supplying said control air from said inlet port to said second supply port and for blocking said second supply port from said exhaust port; and timing means actuated for blocking flow of said control air from said inlet port to said first control valve means after the expiration of a predetermined time period after deactuation of said first control valve means in order to hold the device in the first working position without continuing to supply control air to said first supply port, said timing means being deactuated for supplying said control air from said inlet port to said first control valve means in response to a control air pressure at said first supply port below a predetermined pressure level, said timing means including a pneumatically-actuated timing valve means having a pneumatic actuator thereon, said timing valve means being deactuable for supplying said control air from said inlet port to said first control valve means, said timing valve means being actuable for blocking flow of said control air from said inlet port to said first control valve means, and a timing orifice connected in fluid communication between said first supply port and said actuator of said timing valve means for supplying control air to said actuator of said timing valve means at a predetermined flow rate in order to actuate said timing valve means after said predetermined time period, said timing orifice allowing flow of control air therethrough at said predetermined flow rate, said timing means further including a check valve in fluid communication with said first supply port for blocking flow through said check valve from said first supply port to said actuator of said timing valve means and for freely allowing flow through said check valve from the actuator of said timing valve means to said first supply port, said check valve and said timing orifice being connected in parallel fluid communication between said first supply port and said actuator of said timing valve means, thereby causing control air to flow from said first supply port to said actuator of said timing valve means only through said timing orifice, but freely allowing flow from said actuator of said timing valve means to said exhaust port when said first control valve means is actuated for exhausting said first supply port to said exhaust port, said timing means being deactuable in response to said control air pressure at said first supply port being below said predetermined pressure level when said first control valve means is actuated for exhausting said first supply port to said exhaust port, and said timing means also being deactuable in response to said control air pressure at said first supply port being below said predetermined pressure level when a predetermined amount of leakage has occurred in the pneumatically-operated device.

30. A pneumatic control system according to claim 29, wherein said pneumatically-operated device is a pneumatic cylinder having a piston therein forcibly movable between said first and second working positions, said piston having a work-performing member attached thereto and movable therewith, said work-performing member being forcibly extended into a molten mass of aluminum for breaking up slag therein in an aluminum processing operation when said work-performing member is in said second working position, said work-performing member being withdrawn from said molten mass when in said first working position.

31. A pneumatic control system according to claim 30, further comprising a monitoring port in fluid communication with said first supply port, said monitoring port being connectable to monitoring means for monitoring at least one fluid parameter at said first supply port.

32. A pneumatic control system for selectively controlling the movement of a pneumatically-operated device between first and second working positions, said control system having control air inlet port connected to a source of pressurized control air, an exhaust port, first and second supply ports for selectively supplying control air to forcibly urge the device to the first and second working positions, respectively, and a pilot air inlet port connected to a selectively actuable and deactuable source of pressurized pilot air for selectively actuating and deactuating said control system, said control system further comprising:

first control valve means deactuated when said control system is deactuated for supplying said control air from said inlet port to said first supply port and for blocking said first supply port from said exhaust port, said first control valve means being actuated when said control system is actuated for blocking flow of said control air from said inlet port to said first supply port and for exhausting said first supply port to said exhaust port;

second control valve means deactuated when said control system is deactuated for blocking flow of said control air from said inlet port to second supply port and for exhausting said second supply port to said exhaust port, said second control valve means being actuated when said control system is actuated for supplying said control air from said inlet port to said second supply port and for blocking said second supply port from said exhaust port;

timing means actuated for blocking flow of said control air from said inlet port to said first control valve means after the expiration of a predetermined time period after deactuation of said first control valve means in order to hold the device in the first working position without continuing to supply control air to said first supply port, said timing means being deactuated for supplying said control air from said inlet port to said first control valve means in response to a control air pressure at said first supply port below a predetermined pressure level, said timing means including a pneumatically-actuated timing valve means having a pneumatic actuator thereon, said timing valve means being deactuable for supplying said control air from said inlet port to said first control valve means, said timing valve means being actuable for blocking flow of said control air from said inlet port to said first control valve means, and a timing orifice connected in fluid communication between said first supply port and said actuator of said timing valve means for supplying control air to said actuator of said timing valve means at a predetermined flow rate in order to actuate said timing valve means after said predetermined time period, said timing orifice allowing flow of control air therethrough at said predetermined flow rate, said timing means further including a check valve in fluid communication with said first supply port for blocking flow through said check valve from said first supply port to said actuator of said timing valve means and for freely allowing flow through said check valve from the actuator of said timing valve means to said first supply port, said check valve and said timing orifice being connected in parallel fluid communication between said first supply port and said actuator of said timing valve means, thereby causing control air to flow from said first supply port to said actuator of said timing valve means only through said timing orifice, but freely allowing flow from said actuator of said timing valve means to said exhaust port when said first control valve means is actuated for exhausting said first supply port to said exhaust port, said timing means being deactuable in response to said control air pressure at said first supply port being below said predetermined pressure level when said first control valve means is actuated for exhausting said first supply port to said exhaust port, and said timing means also being deactuable in response to said control air pressure at said first supply port being below said predetermined pressure level when a predetermined amount of leakage has occurred in the pneumatically-operated device; and testing means for selectively actuating said timing valve means in order to block flow of said control air from said inlet port to said first control valve means regardless of whether said first control valve means is deactuated, a monitoring port in fluid communication with said first supply port, and monitoring means in fluid communication with said monitoring port for monitoring at least one fluid parameter at said first supply port, said monitoring means being adapted for monitoring any leakage in the pneumatically-operated device, said testing means including a test port connected to a selectively actuable and deactuable source of pressurized test air, and shuttle valve means in fluid communication with said test port, said timing orifice, and said actuator of said timing valve means, said shuttle valve means allowing flow of said test air from said test port to said actuator of said timing valve means and blocking flow from said timing orifice to said actuator of said timing valve means when said source of said test air is actuated, and said shuttle valve means allowing flow from said timing orifice to said actuator of said timing valve means and blocking flow from said test port to said actuator of said timing valve means when said source of said test air is deactuated.

33. A pneumatic control system according to claim 32, wherein said pneumatically-operated device is a pneumatic cylinder having a piston therein forcibly movable between said first and second working positions, said piston having a work-performing member attached thereto and movable therewith.

34. A pneumatic control system according to claim 33, wherein said work-performing member is forcibly extended into a molten mass of aluminum for breaking up slag therein in an aluminum processing operation when said work-performing member is in said second working position, said work-performing member being withdrawn from said molten mass when in said first working position.

35. A pneumatic control system for selectively controlling the movement of a pneumatically-operated device between first and second working positions, said control system having control air inlet port connected to a source of pressurized control air, an exhaust port, first and second supply ports for selectively supplying control air to forcibly urge the device to the first and second working positions, respectively, and a pilot air inlet port connected to a selectively actuable and deactuable source of pressurized pilot air for selectively actuating and deactuating said control system, said control system further comprising:

first control valve means deactuated when said control system is deactuated for supplying said control air from said inlet port to said first supply port and for blocking said first supply port from said exhaust port, said first control valve means being actuated when said control system is actuated for blocking flow of said control air from said inlet port to said first supply port and for exhausting said first supply port to said exhaust port;

second control valve means deactuated when said control system is deactuated for blocking flow of said control air from said inlet port to second supply port and for exhausting said second supply port to said exhaust port, said second control valve means being actuated when said control system is actuated for supplying said control air from said inlet port to said second supply port and for blocking said second supply port from said exhaust port;

timing means actuated for blocking flow of said control air from said inlet port to said first control valve means after the expiration of a predetermined time period after deactuation of said first control valve means in order to hold the device in the first working position without continuing to supply control air to said first supply port, said timing means being deactuated for supplying said control air from said inlet port to said first control valve means in response to a control air pressure at said first supply port below a predetermined pressure level, said timing means including a pneumatically-actuated timing valve means having a pneumatic actuator thereon, said timing valve means being deactuable for supplying said control air from said inlet port to said first control valve means, said timing valve means being actuable for blocking flow of said control air from said inlet port to said first valve means, and a timing orifice connected in fluid communication between said first supply port and said actuator of said timing valve means for supplying control air to said actuator of said timing valve means at a predetermined flow rate in order to actuate said timing valve means after said predetermined time period, said timing orifice allowing flow of control air therethrough at said predetermined flow rate, said timing means further including a check valve in fluid communication with said first supply port for blocking flow through said check valve from said first supply port to said actuator of said timing valve means and for freely allowing flow through said check valve from the actuator of said timing valve means to said first supply port, said check valve and said timing orifice being connected in parallel fluid communication between said first supply port and said actuator of said timing valve means, thereby causing control air to flow from said first supply port to said actuator of said timing valve means only through said timing orifice, but freely allowing flow from said actuator of said timing valve means to said exhaust port when said first control valve means is actuated for exhausting said first supply port to said exhaust port, said timing means being deactuable in response to said control air pressure at said first supply port being below said predetermined pressure level when said first control valve means is actuated for exhausting said first supply port to said exhaust port, and said timing means also being deactuable in response to said control air pressure at said first supply port being below said predetermined pressure level when a predetermined amount of leakage has occurred in the pneumatically-operated device; and selectively actuable and deactuable exhaust valve means in fluid communication with said first control valve means, said actuator of said timing valve means, and said exhaust port, said exhaust valve means being deactuated when said control system is deactuated for blocking flow therethrough from said actuator of said timing valve means to said exhaust port and for allowing actuation of said timing valve means, and said exhaust valve means being actuated when said control system is actuated for providing flow therethrough from said actuator of said timing valve means to said exhaust port and for allowing deactuation of said timing valve means.

36. A pneumatic control system according to claim 35, wherein said timing means further includes a check valve in fluid communication with said first supply port for blocking flow through said check valve from said first supply port to said actuator of said timing valve means and for freely allowing flow through said check valve from the actuator of said timing valve means to said first supply port, said check valve and said timing orifice being connected in parallel fluid communication between said first supply port and said actuator of said timing valve means, thereby causing control air to flow from said first supply port to said actuator of said timing valve means only through said timing orifice, but freely allowing flow from said actuator of said timing valve means to said exhaust port when said first control valve means is actuated for exhausting said first supply port to said exhaust port.

37. A pneumatic control system according to claim 35, wherein said pneumatically-operated device is a pneumatic cylinder having a piston therein forcibly movable between said first and second working positions, said piston having a work-performing member attached thereto and movable therewith.

38. A pneumatic control system according to claim 37, wherein said work-performing member is forcibly extended into a molten mass of aluminum for breaking up slag therein in an aluminum processing operation when said work-performing member is in said second working position, said work-performing member being withdrawn from said molten mass when in said working position.

39. A pneumatic control system for selectively controlling the movement of a pneumatically-operated device between first and second working positions, said control system having control air inlet port connected to a source of pressurized control air, an exhaust port, first and second supply ports for selectively supplying control air to forcibly urge the device to the first and second working positions, respectively, and a pilot air inlet port connected to a selectively actuable and deactuable source of pressurized pilot air for selectively actuating and deactuating said control system, said control system further comprising:

first control valve means deactuated when said control system is deactuated for supplying said control air from said inlet port to said first supply port and for blocking said first supply port from said exhaust port, said first control valve means being actuated when said control system is actuated for blocking flow of said control air from said inlet port to said first supply port and for exhausting said first supply port to said exhaust port;

second control valve means deactuated when said control system is deactuated for blocking flow of said control air from said inlet port to second supply port and for exhausting said second supply port to said exhaust port, said second control valve means being actuated when said control system is actuated for supplying said control air from said inlet port to said second supply port and for blocking said second supply port from said exhaust port;

timing means actuated for blocking flow of said control air from said inlet port to said first control valve means after the expiration of a predetermined time period after deactuation of said first control valve means in order to hold the device in the first working position without continuing to supply control air to said first supply port, said timing means being deactuated for supplying said control air from said inlet port to said first control valve means in response to a control air pressure at said first supply port below a predetermined pressure level, said timing means including a pneumatically-actuated timing valve means having a pneumatic actuator thereon, said timing valve means being deactuable for supplying said control air from said inlet port to said first control valve means, said timing valve means being actuable for blocking flow of said control air from said inlet port to said first control valve means, and a timing orifice connected in fluid communication between said first supply port and said actuator of said timing valve means for supplying control air to said actuator of said timing valve means at a predetermined flow rate in order to actuate said timing valve means after said predetermined time period, said timing orifice allowing flow of control air therethrough at said predetermined flow rate, said timing means further including a check valve in fluid communication with said first supply port for blocking flow through said check valve from said first supply port to said actuator of said timing valve means and for freely allowing flow through said check valve from the actuator of said timing valve means to said first supply port, said check valve and said timing orifice being connected in parallel fluid communication between said first supply port and said actuator of said timing valve means, thereby causing control air to flow from said first supply port to said actuator of said timing valve means only through said timing orifice, but freely allowing flow from said actuator of said timing valve means to said exhaust port when said first control valve means is actuated for exhausting said first supply port to said exhaust port, said timing means being deactuable in response to said control air pressure at said first supply port being below said predetermined pressure level when said first control valve means is actuated for exhausting said first supply port to said exhaust port, and said timing means also being deactuable in response to said control air pressure at said first supply port being below said predetermined pressure level when a predetermined amount of leakage has occurred in the pneumatically-operated device; and regulator means for preventing actuation of said timing valve means when said control air pressure at said first supply port is below said predetermined pressure level, said regulator means including a self-relieving pressure regulator in fluid communication between said inlet port and said actuator of said timing valve means, said regulator providing flow therethrough from said inlet port to said actuator of said timing valve means to oppose said actuation of said timing valve means when said control air pressure at said first supply port is below said predetermined pressure, said regulator self-relieving in order to exhaust flow from said inlet port therethrough when said control air pressure at said first supply port is at or above said predetermined pressure level.

40. A pneumatic control system according to claim 39, further comprising monitoring gauge means for monitoring the pressure of the control air flowing through said regulator to said actuator of said timing valve means.

41. A pneumatic control system according to claim 39, wherein said pneumatically-operated device is a pneumatic cylinder having a piston therein forcibly movable between said first and second working positions, said piston having a work-performing member attached thereto and movable therewith.

42. A pneumatic control system according to claim 41, wherein said work-performing member is forcibly extended into a molten mass of aluminum for breaking up slag therein in an aluminum processing operation when said work-performing member is in said second working position, said work-performing member being withdrawn from said molten mass when in said first working position.

43. A pneumatic control system for selectively controlling the movement of a pneumatically-operated device between first and second working positions, said control system having control air inlet port connected to a source of pressurized control air, an exhaust port, first and second supply ports for selectively supplying control air to forcibly urge the device to the first and second working positions, respectively, and a pilot air inlet port connected to a selectively actuable and deactuable source of pressurized pilot air for selectively actuating and deactuating said control system, said control system further comprising:

first control valve means deactuated when said control system is deactuated for supplying said control air from said inlet port to said first supply port and for blocking said first supply port from said exhaust port, said first control valve means being actuated when said control system is actuated for blocking flow of said control air from said inlet port to said first supply port and for exhausting said first supply port to said exhaust port;

second control valve means deactuated when said control system is deactuated for blocking flow of said control air from said inlet port to second supply port and for exhausting said second supply port to said exhaust port, said second control valve means being actuated when said control system is actuated for supplying said control air from said inlet port to said second supply port and for blocking said second supply port from said exhaust port;

timing means actuated for blocking flow of said control air from said inlet port to said first control valve means after the expiration of a predetermined time period after deactuation of said first control valve means in order to hold the device in the first working position without continuing to supply control air to said first supply port, said timing means being deactuated for supplying said control air from said inlet port to said first control valve means in response to a control air pressure at said first supply port below a predetermined pressure level, said timing means including a pneumatically-actuated timing valve means having a pneumatic actuator thereon, said timing valve means being deactuable for supplying said control air from said inlet port to said first control valve means, said timing valve means being actuable for blocking flow of said control air from said inlet port to said first control valve means, and a timing orifice connected in fluid communication between said first supply port and said actuator of said timing valve means for supplying control air to said actuator of said timing valve means at a predetermined flow rate in order to actuate said timing valve means after said predetermined time period, said timing orifice allowing flow of control air therethrough at said predetermined flow rate, said timing means further including a check valve in fluid communication with said first supply port for blocking flow through said check valve from said first supply port to said actuator of said timing valve means and for freely allowing flow through said check valve from the actuator of said timing valve means to said first supply port, said check valve and said timing orifice being connected in parallel fluid communication between said first supply port and said actuator of said timing valve means, thereby causing control air to flow from said first supply port to said actuator of said timing valve means only through said timing orifice, but freely allowing flow from said actuator of said timing valve means to said exhaust port when said first control valve means is actuated for exhausting said first supply port to said exhaust port, said timing means being deactuable in response to said control air pressure at said first supply port being below said predetermined pressure level when said first control valve means is actuated for exhausting said first supply port to said exhaust port, and said timing means also being deactuable in response to said control air pressure at said first supply port being below said predetermined pressure level when a predetermined amount of leakage has occurred in the pneumatically-operated device; and selectively actuable and deactuable solenoid valve means for respectively actuating and deactuating said source of pressurized pilot air in order to respectively actuate and deactuate said control system, said solenoid valve means providing for system-actuating fluid communication therethrough from said source of pressurized pilot air to said first and second control valve means when said solenoid valve means is electrically actuated, said solenoid valve means blocking said system-actuating fluid communication and providing for system-deactuating fluid communication therethrough from said first and second control valve means to said exhaust port when said solenoid valve means is electrically deactuated.

44. A pneumatic control system according to claim 43, wherein said source of pressurized pilot air is control air inlet port.

45. A pneumatic control system according to claim 44, wherein said pneumatically-operated device is a pneumatic cylinder having a piston therein forcibly movable between said first and second working positions, said piston having a work-performing member attached thereto and movable therewith.

46. A pneumatic control system according to claim 45, wherein said work-performing member is forcibly extended into a molten mass of aluminum for breaking up slag therein in an aluminum processing operation when said work-performing member is in said second working position, said work-performing member being withdrawn from said molten mass when in said first working position.

* * * * *

UNITED STATES PATENT AND TRADEMARK OFFICE

CERTIFICATE OF CORRECTION

PATENT NO. : 5,163,353

DATED : November 17, 1992

INVENTOR(S) : Horstmann, et al

It is certified that error appears in the above-identified patent and that said Letters Patent is hereby corrected as shown below:

On the Title Page under "Other Documents" insert the following heading and information:

--OTHER DOCUMENTS--

--ROSS AIR CONTROLS - Catalog 501B page 12--.

Column 6, line 60, "conditin" should be --condition--.

Column 13, line 1, Claim 7, "occured" should be --occurred--.

Column 14, line 58, Claim 21, "repsonse" should be --response--.

Column 19, line 47, Claim 35, after "first" insert --control--.

Column 20, line 58, Claim 38, after "said" (second occurrence) insert --first--.

UNITED STATES PATENT AND TRADEMARK OFFICE

CERTIFICATE OF CORRECTION

PATENT NO. : 5,163,353

DATED : November 17, 1992

INVENTOR(S) : Horstmann, et. al.

It is certified that error appears in the above-indentified patent and that said Letters Patent is hereby corrected as shown below:

Column 11, line 14, "638" should be --438--.

Signed and Sealed this

Ninth Day of November, 1993

Bruce Lehman

*Attest:*

BRUCE LEHMAN

*Attesting Officer*

*Commissioner of Patents and Trademarks*